US007861468B1

(12) United States Patent
Gernstein

(10) Patent No.: US 7,861,468 B1
(45) Date of Patent: Jan. 4, 2011

(54) WINDOW WELL

(76) Inventor: Dan H. Gernstein, 2306 N. 160th St., Omaha, NE (US) 68116

( * ) Notice: Subject to any disclaimer, the term of this patent is extended or adjusted under 35 U.S.C. 154(b) by 376 days.

(21) Appl. No.: 11/598,344

(22) Filed: Nov. 13, 2006

Related U.S. Application Data

(60) Provisional application No. 60/849,709, filed on Oct. 5, 2006.

(51) Int. Cl.
*E04F 17/06* (2006.01)

(52) U.S. Cl. ..... 52/107; 52/19; 52/169.1

(58) Field of Classification Search ..... 52/170, 52/19, 167, 169.1
See application file for complete search history.

(56) References Cited

U.S. PATENT DOCUMENTS 2,898,638 A * 8/1959 Druckhamer ..... 52/107
6,484,455 B1 * 11/2002 Poole ..... 52/107
6,581,338 B2 * 6/2003 Koenig et al. ..... 52/107
6,915,612 B2 * 7/2005 Oakley ..... 52/107
7,356,968 B2 * 4/2008 Joyce et al. ..... 52/19
7,444,784 B2 * 11/2008 Brown ..... 52/107
2003/0182877 A1 * 10/2003 Worth ..... 52/107

* cited by examiner

*Primary Examiner*—Brian E Glessner
*Assistant Examiner*—Patrick Maestri
(74) *Attorney, Agent, or Firm*—Dennis L. Thomte; Thomte Patent Law Office LLC

(57) ABSTRACT

A window well for use by a person to escape through a window formed in a basement wall including a generally U-shaped body member having upper and lower ends and inner and outer ends. The open upper end of the body member has a spacer and a removable lid mounted thereon. The body member is comprised of a composite material such as fiberglass.

1 Claim, 3 Drawing Sheets

WINDOW WELL

CROSS-REFERENCE TO RELATED APPLICATION

This application claims the benefit of U.S. Provisional Application Ser. No. 60/849,709 entitled WINDOW WELL filed Oct. 5, 2006, the disclosure of which is hereby incorporated herein by reference.

BACKGROUND OF THE INVENTION

1. Field of the Invention

This invention relates to a window well and more particularly to a window well which provides an emergency escape structure from a basement window.

2. Description of the Related Art

Many city or municipal codes require that if a bedroom is located in a basement, there must be some means of escape from the bedroom. In the past, it is believed that large window wells have been provided which do provide a means of escaping from a basement bedroom window with the same being constructed of timbers, ties, concrete blocks, etc. It is believed that the prior art structures are difficult to build or construct, are not aesthetically pleasing in appearance are not durable, and do not have a cover at the top thereof which prevents debris from accumulating in the window well.

SUMMARY OF THE INVENTION

A window well for a basement window is provided which is constructed of a fiberglass material and which is sufficiently large enough to provide an emergency escape route from a basement bedroom window. The window well structure of this invention includes a bottom having a drain opening formed therein. The window well includes a spacer element which extends between the opposite walls thereof adjacent the basement wall and a translucent or transparent lid or cover positioned outwardly of the spacer. The spacer maintains the window well structure in its desired configuration. The lid permits light to pass therethrough with the spacer and lid preventing debris from accumulating in the window well. The lid is removable from the inside of the window well by simply pushing upwardly thereagainst.

It is therefore a principal object of the invention to provide an improved window well.

A further object of the invention is to provide a window well which provides an emergency access from a basement bedroom window.

A further object of the invention is to provide a window well structure which is durable in use and will not rot in the ground.

Still another object of the invention is to provide a window well which is aesthetically pleasing.

Yet another object of the invention is to provide a window well of the type described which includes a lid which is easily removable from the inside of the well to facilitate egress therethrough.

Still another object of the invention is to provide a window well of the type described which is constructed primarily of fiberglass.

Still another object of the invention is to provide a window well of the type described which is easy to ship and easy to install.

These and other objects will be apparent to those skilled in the art.

DETAILED DESCRIPTION OF THE INVENTION

Figure 1:
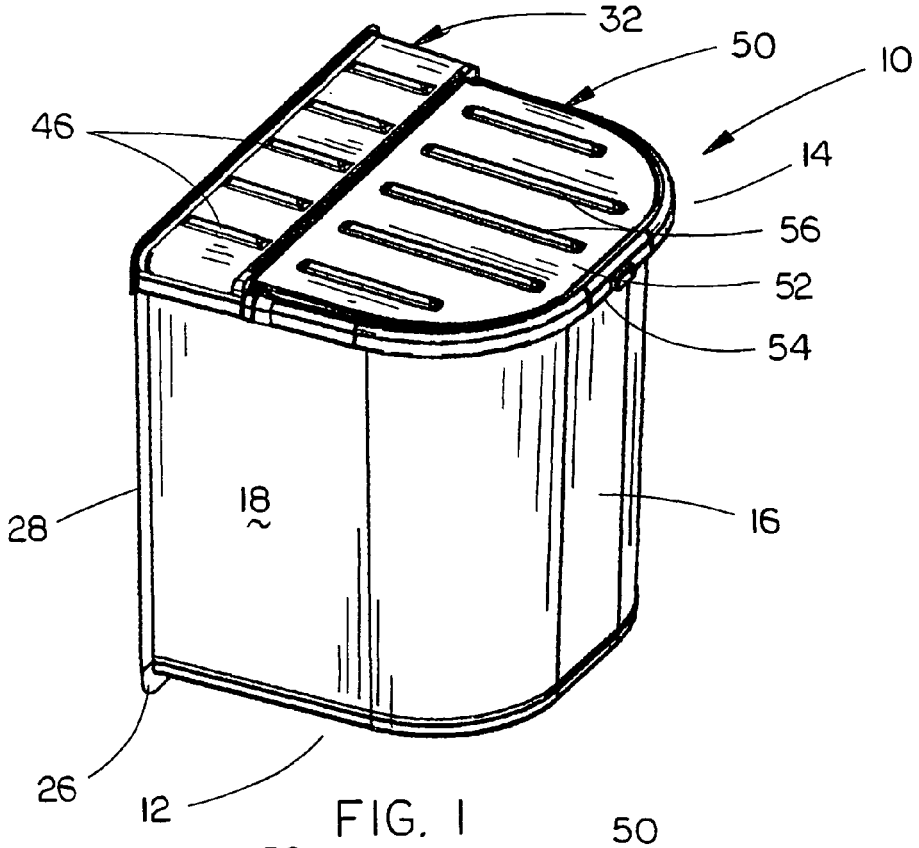
FIG. 1 is a front perspective view of the window well of this invention with the spacer and lid mounted thereon.
Figure 2:
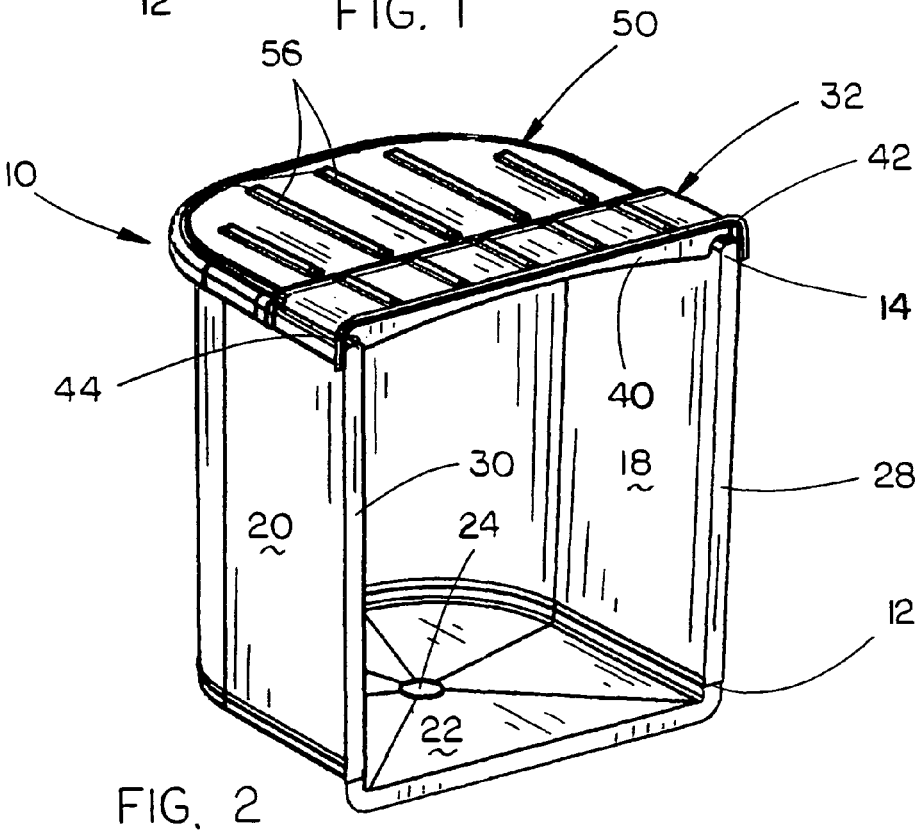
FIG. 2 is a rear perspective view of the window well of FIG. 1.
Figure 3:
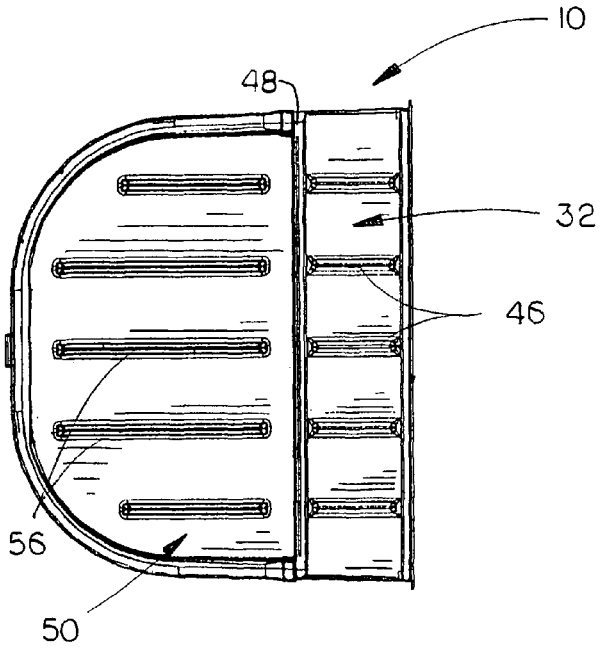
FIG. 3 is a top view of the window well of FIG. 1.
Figure 4:
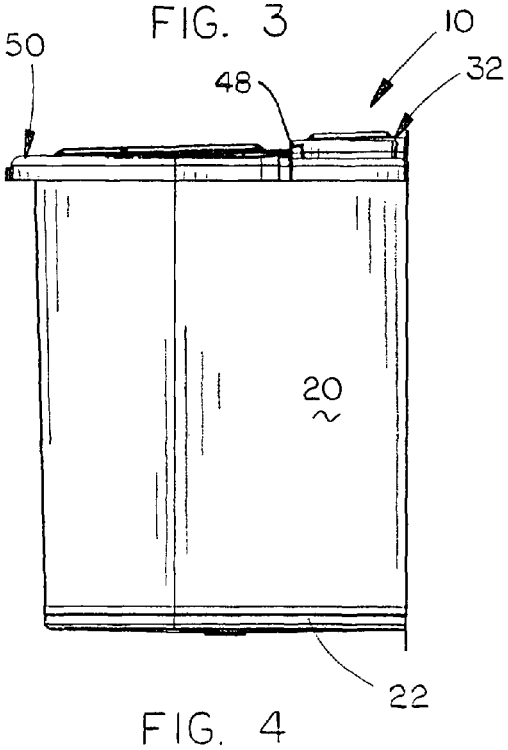
FIG. 4 is a left side view of the window well of FIG. 1.

The window well of this invention is referred to generally by the reference numeral 10 which is generally U-shaped in cross-section. Window well 10 is of one-piece construction and includes a lower end 12, an upper end 14, a front portion 16 and opposite side portions 18 and 20 for purposes of description. The upper end 14 of window well 10 is open while the lower end 12 of window well 10 is preferably closed by means of a fiberglass bottom or floor secured to the lower end of the window well by means of glue or other convenient means. Bottom 22 is provided with a drain opening 24. The rearward end of bottom 22 is provided with a flange 26 to provide a mounting surface for attachment to the exterior wall of the basement to which the window well will be attached. The rearward ends of side portions 18 and 20 are provided with laterally extending flanges 28 and 30, respectively, to provide a mounting surface for attachment to the exterior of the basement wall.

The window well 10 is comprised of a fiberglass material having a gel coat thereon which is treated to prevent the material from fading. The fiberglass material is preferably glass reinforced in conventional fashion for strengthening purposes. The flanges 26, 28 and 30 are preferably comprised of an aluminum material and would be embedded in the fiberglass material. The flanges will normally have openings formed therein so that anchors or other fasteners may be extended therethrough to secure the well to the exterior surface of the basement wall. Preferably, the height of the window well 10 is between forty-eight inches and sixty inches with the width between the side portions being preferably fifty-four inches.

Figure 5:
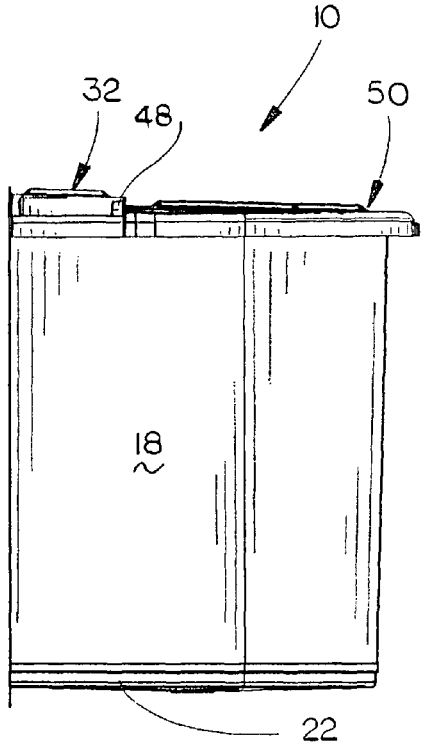
FIG. 5 is a right side view of the window well of FIG. 1.
Figure 6:
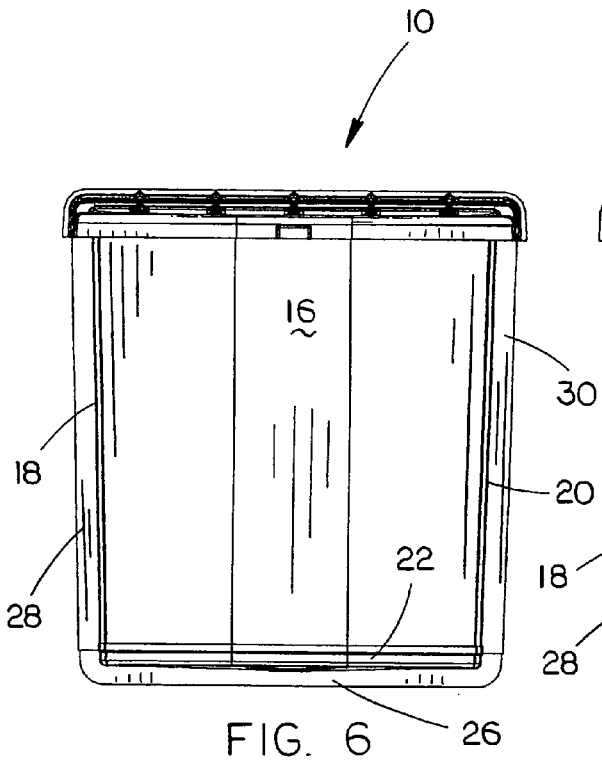
FIG. 6 is a front view of the window well of FIG. 1.
Figure 7:
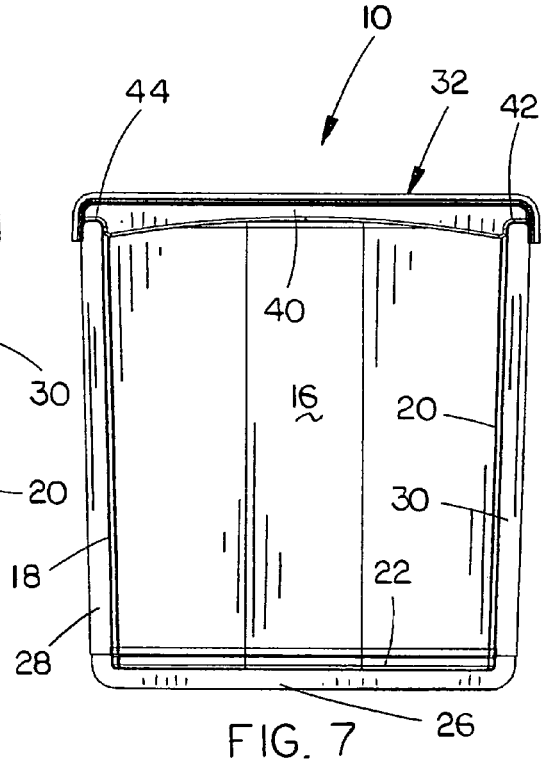
FIG. 7 is a rear view of the window well of FIG. 1.
Figure 8:
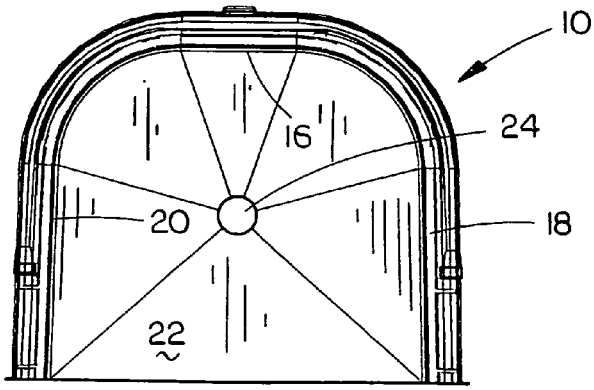
FIG. 8 is a top view of the window well with the spacer and lid removed.

The window well 10 is provided with a fiberglass spacer 32 which includes a top wall 34 and downwardly depending sides 36 and 38. The downwardly depending sides 36 and 38 embrace the upper end of the window well 10 as seen in FIG. 5. The underside of spacer 32 is provided with a member 40 having recesses 42 and 44 at its opposite ends which receive the upper ends of side portions 18 and 20, respectively, and maintains the shape of the window well 10 against pressures within the ground. The spacer 32 ensures that the side portions 18 and 20 may not move towards one another or move away from one another. The spacer 32 is preferably glued or otherwise secured to the upper ends of the window well 10 at the factory. The spacer 32 includes a plurality of longitudinally extending reinforcing ribs 46, as seen in the drawings. The outer end of spacer 32 is provided with a slot or recess 48 formed therein adapted to receive the inner end of lid or cover 50 which is preferably comprised of a translucent lexan material. Lid 50 includes an upper portion 52 having a downwardly depending flange 54 extending therefrom which embraces the upper ends of side portions 18 and 20 and front portion 16. The lid 50 is preferably provided with a plurality of longitudinally extending reinforcing ribs 56 with the rearward end of lid 50 being received in the slot or recess 48, as described above, to maintain the lid in position so as to prevent rainwater or debris from entering the interior of the window well 10. The lid or cover 50 may be easily removed from the window well 10 from the inside of the window well by simply pressing upwardly thereon.

Normally, the window well 10 will be installed or mounted on the exterior surface of the basement wall prior to backfilling with the interior of the window well 10 being in communication with a basement window. Should water somehow enter the interior of the window well 10, it may drain therefrom through the drain opening 24. Regardless of pressures within the ground such as may be created by backfill or water, the spacer 32 maintains the shape of the window well 10. As previously stated, the flanges 26, 28 and 30 will be anchored or otherwise secured to the exterior surface of the basement wall to maintain the window well 10 in position. Normally, the lid 50 will be installed on the window well so as to prevent debris from entering the window well. The translucent characteristic of the lid 50 enables sunlight to pass therethrough to permit light to enter the basement window.

In the event that a person must escape from the house during a fire or the like, the person will open the basement window and enter the interior of the window well 10. The person will push upwardly on the lid 50 so that the person may climb out of the window well through the open upper end of the window well 10. A ladder may be optionally positioned within the window well 10 to aid in the egress therefrom.

Not only is the window well 10 of this invention easy to ship, but it is easy to install on the basement wall. A certain amount of the upper portion of the window well 10 will be exposed above the ground surface and the fiberglass composition of the window well will be aesthetically pleasing.

Thus it can be seen that the invention accomplishes at least all of its stated objectives.

I claim:

1. A window well for use by a person to escape through a window formed in a basement wall, comprising:

a vertically disposed and generally U-shaped body member including an outer wall, opposite side walls, and an open upper end;

said body member having a lower end and a horizontally disposed upper end;

said upper end of said body member having an inverted U-shape;

a generally rectangular shaped and horizontally disposed spacer member secured to said upper ends of said side walls and extending therebetween;

said spacer member including a top wall having an inner end, and outer end, and downwardly extending side edges which have lower ends;

said spacer member having a member with opposite ends, at its underside and which has an upwardly extending recess formed in each of its opposite ends with said recesses cooperating with said side edges of said spacer member to define inverted U-shaped channels which receive the inverted U-shaped upper ends of said side walls so that said side walls may not move towards one another or move away from one another;

said outer end of said spacer member having a recess formed therein which extends horizontally inwardly between said side edges thereof;

a one-piece lid, having inner and outer ends, removably positioned on said upper end of said outer wall and said upper ends of said side walls outwardly of said spacer;

said inner end of said lid being selectively removably received by said recess in said outer end of said spacer to maintain said lid in position on said body member and to prevent rainwater or debris from entering the interior of the window well;

said body member being comprised of a composite material.

* * * * *